US010084248B2

(12) United States Patent
Boisnier et al.

(10) Patent No.: US 10,084,248 B2
(45) Date of Patent: Sep. 25, 2018

(54) FREELY TRANSLATABLE ELECTRICAL CONNECTION DEVICE HAVING PROTECTION AGAINST DAMAGE FROM FOREIGN BODIES

(71) Applicant: SAFRAN ELECTRICAL & POWER, Blagnac (FR)

(72) Inventors: Benjamin Boisnier, Colomiers (FR); Jean-Luc Biesse, Saint Lieux les Lavaur (FR)

(73) Assignee: SAFRAN ELECTRICAL & POWER, Blagnac (FR)

( * ) Notice: Subject to any disclaimer, the term of this patent is extended or adjusted under 35 U.S.C. 154(b) by 0 days.

(21) Appl. No.: 15/744,907

(22) PCT Filed: Jul. 8, 2016

(86) PCT No.: PCT/FR2016/051746

§ 371 (c)(1),
(2) Date: Jan. 15, 2018

(87) PCT Pub. No.: WO2017/009558

PCT Pub. Date: Jan. 19, 2017

(65) Prior Publication Data

US 2018/0212346 A1 Jul. 26, 2018

(30) Foreign Application Priority Data

Jul. 16, 2015 (FR) ..... 15 56708

(51) Int. Cl.
*H01R 4/40* (2006.01)
*H01R 11/22* (2006.01)
*H01R 24/28* (2011.01)

(52) U.S. Cl.
CPC ..... *H01R 4/40* (2013.01); *H01R 11/22* (2013.01); *H01R 24/28* (2013.01)

(58) Field of Classification Search
CPC ..... H01R 4/40
See application file for complete search history.

(56) References Cited

U.S. PATENT DOCUMENTS 2,216,309 A * 10/1940 Bissell ..... H01R 4/40 439/791
4,001,921 A * 1/1977 Lawlor ..... H01R 4/40 24/132 R (Continued)

FOREIGN PATENT DOCUMENTS

FR 1555818 A 1/1969
FR 2067893 A5 8/1971

(Continued)

OTHER PUBLICATIONS

International Search Report for International Application No. PCT/FR2016/051746 dated Oct. 10, 2016.

(Continued)

*Primary Examiner* — James Harvey
(74) *Attorney, Agent, or Firm* — Pearne & Gordon LLP

(57) ABSTRACT

The application relates to an electrical connection device (100) including a terminal block (10) adapted for connecting to a lug of an electrical cable. The terminal block (10) comprises a locking sleeve (3) adapted for securing the lug so as to enable translation between the terminal block (10) and the lug. The sleeve (3) comprises a first portion (1) and a second portion (2), as well as a pivot element (13, 14) configured such that the first and second portions (1, 2) pivot relative to one another. The pivot element comprises a pin (14) which is connected to the second portion (2) and engaged with the first portion (1) on the side of the first portion (1) substantially opposite the side of the first portion (1) facing the second portion (2). Advantageously, relative rotational is also allowed. A busbar is preferably connected to the terminal block.

10 Claims, 3 Drawing Sheets

(56) References Cited

U.S. PATENT DOCUMENTS

| | | | | |
|---|---|---|---|---|
| 4,143,446 | A * | 3/1979 | Down | F16G 11/06 24/115 R |
| 4,705,480 | A | 11/1987 | Dumontet | |
| 4,898,551 | A * | 2/1990 | Cornell | H01R 4/40 439/789 |
| 5,401,194 | A * | 3/1995 | Cornell | H01R 4/5008 439/789 |
| 8,562,371 | B2 | 10/2013 | Biesse | |
| 2007/0167087 | A1* | 7/2007 | Tamm | H01R 4/36 439/798 |
| 2011/0237104 | A1 | 9/2011 | Biesse | |
| 2013/0137294 | A1* | 5/2013 | Cardin | H01R 4/40 439/517 |

FOREIGN PATENT DOCUMENTS

| | | | |
|---|---|---|---|
| FR | 2578497 | A1 | 9/1986 |
| FR | 2932613 | A1 | 12/2009 |
| FR | 2935202 | A1 | 2/2010 |

OTHER PUBLICATIONS

Preliminary French Search Report issued in Patent Application No. FR 15 56708 dated May 23, 2016.

* cited by examiner

FREELY TRANSLATABLE ELECTRICAL CONNECTION DEVICE HAVING PROTECTION AGAINST DAMAGE FROM FOREIGN BODIES

This is a National Stage application of PCT international application PCT/FR2016/051746, filed on Jul. 8, 2016 which claims the priority of French Patent Application No. 15 56708 entitled "FREELY TRANSLATABLE ELECTRICAL CONNECTION DEVICE HAVING PROTECTION AGAINST DAMAGE FROM FOREIGN BODIES", filed Jul. 16, 2015, both of which are incorporated herein by reference in their entirety.

TECHNICAL FIELD

The invention relates to the field of electrical power connection, and more specifically to the field of terminal blocks in order to enable a freely movable power connection with an electrical cable.

More particularly, the invention relates to an electrical connection device including a terminal block in order to connect to a lug of an electrical cable so as to enable relative translation between said terminal block and said cable, and in particular, but not exclusively, where the terminal block is part of a terminal block and busbar assembly.

Prior Art

The electrical connection assemblies combining terminal blocks and busbars can be found in many industries, and particularly in those associated with the field of electricity and power connection. Such assemblies are used to connect a busbar to an electrical structure, for example an electrical cable, and potentially to other electronic equipment at the same time.

An example of such a terminal block/busbar assembly, connected to an electrical cable, is described in French patent FR 2 935 202 B1 of the Applicant. This document describes a plug, mounted on a cable, which is locked to a terminal block in the form of a socket connected to a busbar. This connection prevents the relative movement in translation between the plug and the terminal block.

Another example of a terminal block/busbar assembly is described in French patent FR 2 932 613 B1 of the Applicant. This document describes a conducting plug, mounted on a cable, in order to connect with a pin connected to a busbar. This connection here again prevents the relative movement between the plug and the pin. Moreover, the plug and the cable must be aligned with the pin before the insertion.

The devices of the examples hereinabove furthermore suffer from requiring precision and potentially, consequently, from tension problems. In particular, if a cable is ever cut a little too short, the electrical connection (between the terminal block and the lug) cannot offset the underlength of the cable. Likewise, if the cable is rigid and has a large section, the electrical connection cannot offset the overlength of the cable. Consequently, the cable has to be adjusted or potentially replaced, which runs the risk that the installers forcefully pull or push on the cable in order to achieve the correct length. In addition to this, it may occur that the cable needs to be twisted so that the terminal block and the lug are aligned before being connected together. These actions can damage the cable and the connections at the two ends of the cable.

Another embodiment of a terminal block/busbar assembly is described in French patent FR 2 578 497 B1. This document describes an expansion joint enabling the relative movement in translation between two terminal block/busbar assemblies thanks to conducting pins.

This latter example allows for the relative movement in translation between a terminal block linked to a bulbar and a conductive pin. However, the relative movement in rotation is prevented.

Another defect of these electrical connections is linked to the aspect of foreign object damage (FOD). The connections described in the documents hereinabove have a non-negligible risk of causing FOD or being subjected to FOD. More particularly, a nut that comes loose, for example, can easily be separated from the electrical connection and can cause an FOD. In addition, the electrical connections are comprised of many parts which increase this risk and make it more difficult to install them. Furthermore, given that the connections are exposed, or are not insulated enough, there is a risk that, during maintenance, an installer tool, for example a screwdriver or an Allen key, can fall onto the electrical connection and cause a short circuit.

DISCLOSURE OF THE INVENTION

The object of this invention is consequently to overcome the aforementioned needs and disadvantages by proposing an electrical connection device including a terminal block adapted for securing a lug without requiring adjusting the length of the electrical cable connected to the lug, and as such make it possible to prevent any problem of tension, and in so much as possible, without requiring adjusting the orientation of the lug. Another object is to provide an electrical connection device comprising fewer parts, that is simple to install, and that has anti-FOD characteristics, i.e. having a substantially reduced probability of causing FOD or of being subjected to FOD, such anti-FOD characteristics being, in particular in the aviation industry, highly sought.

This invention as such proposes an electrical connection device including a terminal block adapted for connecting to a lug of an electrical cable, the terminal block comprising a locking sleeve adapted for securing the lug in such a way as to form an electrical connection enabling relative movement between the terminal block and the secured lug, characterised in that the locking sleeve comprises a first portion and a second portion, as well as a pivot element configured such that the first and second portions pivot relative to one another in order to enable the introduction of the lug and the securing thereof, in that the pivot element of the locking sleeve comprises a pin connected to the second portion of the locking sleeve and engaged with the first portion of the locking sleeve on the side of the first portion substantially opposite the side of the first portion facing the second portion of the locking sleeve, and in that said relative movement is translation.

The electrical connection device can furthermore comprise one or several of the following characteristics taken separately or according to any technically possible combinations.

Preferably, the sleeve of the terminal block is configured to provide a translation movement of the lug over a limited length and for preventing the disconnection thereof of the locking sleeve during the translation.

Preferably, said relative movement furthermore comprises rotation.

Preferably, the pin is located in a groove formed in the first portion of the locking sleeve, the pin extending along an axis substantially perpendicular to an axis along which the terminal block extends substantially.

Preferably, the locking sleeve has a shape that is complementary with that of the lug in order to allow for the engagement thereof.

Preferably, the locking sleeve defines a cylindrical space between the two first and second portions, the locking sleeve being adapted to enable engagement with a lug with a cylindrical rod and an enlarged termination, and in that the rod has a diameter less than that of the locking sleeve and a length greater than that of the locking sleeve.

Even more preferably, the electrical connection device further comprises a busbar connected to the terminal block so as to form a terminal block and a busbar assembly, and an electrical cable with a lug, the lug having a cylindrical rod and an enlarged termination, and in that the rod has a diameter less than that of the locking sleeve and a length greater than that of the locking sleeve.

Preferably, the sleeve comprises a fastening means for the locking of the sleeve.

Moreover, the invention also has for object an electrical connection device and insulator assembly, characterised in that it comprises an electrical connection device such as described hereinabove and an insulator, the electrical connection device being arranged in the insulator, the insulator being provided with walls, the walls extending substantially parallel to the axis of the terminal block and rising to a height greater than that of the terminal block.

Preferably, the insulator comprises a cover for encasing the device.

BRIEF DESCRIPTION OF THE DRAWINGS

It is described in what follows, by way of a non-limiting example, diagrammatically and partially, an embodiment of the invention, by referring to the annexed drawings, wherein.

In all of these figures, identical references can designate identical or similar elements. Furthermore, the figures are not necessarily according to a uniform scale, in order to make the figures easier to read.

DETAILED DESCRIPTION OF A PARTICULAR EMBODIMENT

Figure 1A:
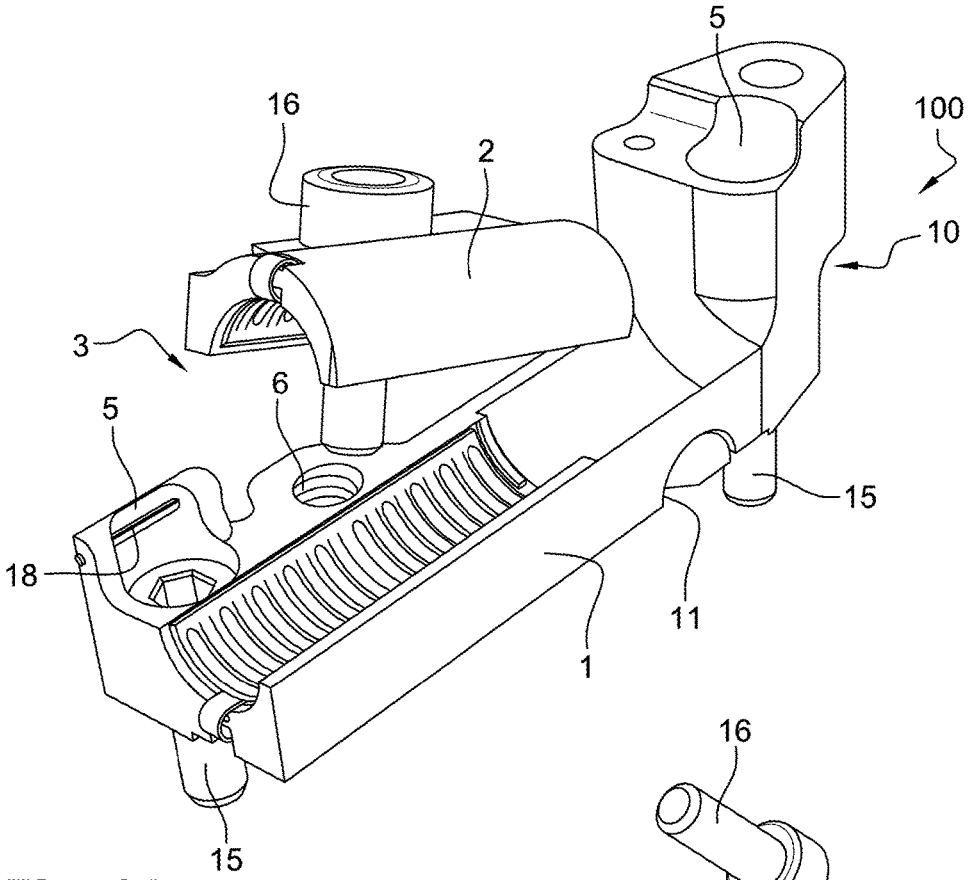
FIG. 1A shows a perspective view of a terminal block of an electrical connection device according to a first embodiment of the invention.
Figure 1B:
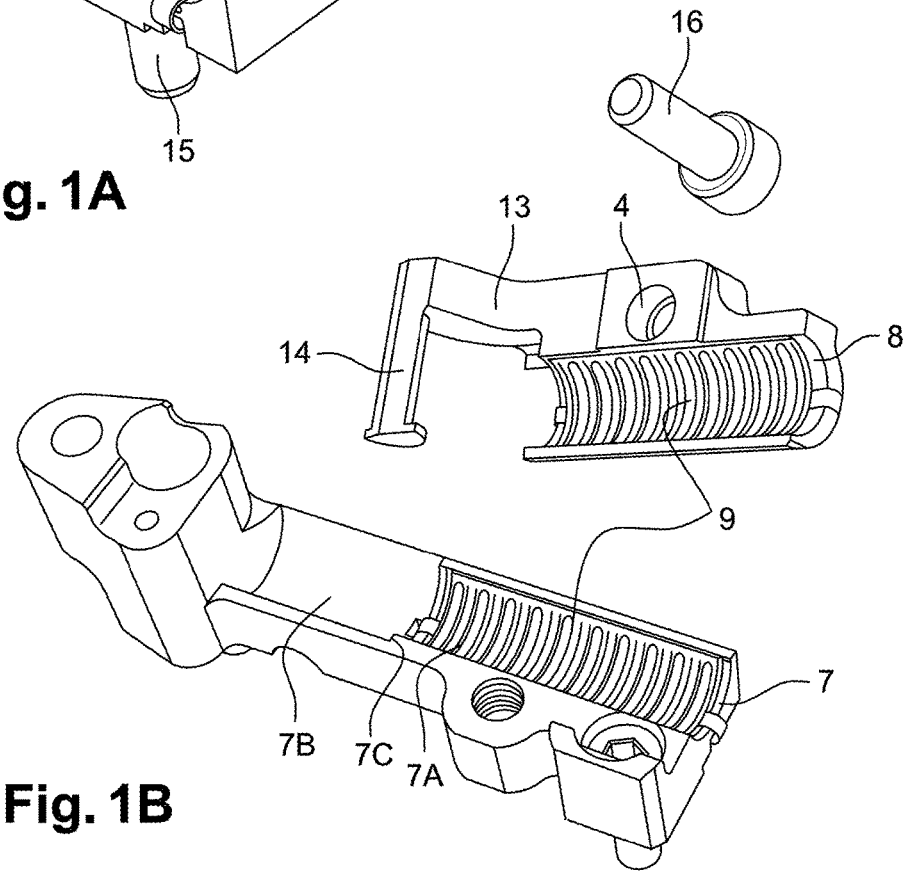
FIG. 1B shows a perspective exploded view of the same terminal block of FIG. 1A.

FIGS. 1A and 1B show a terminal block 10 of an electrical connection device 100 for engaging and securing a lug of an electrical cable, and for supplying a means for electrically connecting a bulbar and an electrical cable. The terminal block 10 substantially has the form of an extended body extending along a first axis and comprising a locking sleeve 3 adapted for securing a lug, being in addition made from a material that conducts electricity. The terminal block 10 is here made of metal and provided with two through-holes 5 in order to secure it to a structure, for example a honeycomb panel (not shown).

The locking sleeve 3 comprises a first portion (lower) 1 and a second portion (upper) 2. The first portion 1 is substantially part of the main body of the terminal block 10 and comprises a channel 7 with a substantially semi-cylindrical shape oriented upwards, while the second portion 2, which is mounted on the first portion 1, comprises a channel 8 with a substantially semi-cylindrical shape oriented downwards. The two portions 1, 2 form a locking sleeve 3 substantially formed from two half-shells defining, thanks to the two channels with a semi-cylindrical shape 7, 8, a cylindrical space extending substantially along said first axis when it is closed.

The two portions 1, 2 of the locking sleeve 3 are intended to be able to be separated, by pivoting, in order to enable the introduction of the lug of a cable. The locking sleeve 3 is provided with a fastening means in order to lock the sleeve and secure the lug of the cable. The fastening means in this case is a screw of the "captive" type 16, passing through a hole 4 on the second portion 2 of the locking sleeve 3 by being secured to the latter in such a way as to be in this case captive. The screw 16 is intended to be engaged with a hole 6 formed in the first portion 1 in order to lock the sleeve 3.

Figure 2:
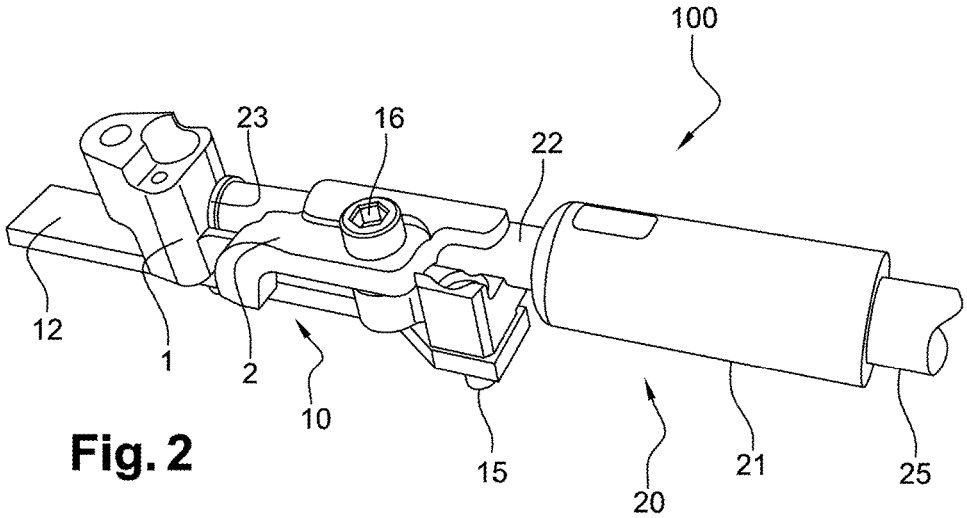
FIG. 2 shows a perspective view of the electrical connection device with a lug secured by the terminal block, according to the first embodiment of the invention.

This terminal block 10 is adapted for receiving a lug and as such form an electrical connection. FIG. 2 clearly shows an electrical connection device 100 formed by a terminal block 10 such as described hereinabove and a lug 20 of an electrical cable 25 attached to said terminal block 10. The lug 20 of the cable 25 is adapted to be engaged with and secured by the locking sleeve 3 of the terminal block 10, and for supplying a means for electrically connecting the cable 25 and the bulbar 12 of the terminal block/bulbar assembly of the device 100. More precisely, the lug 20 comprises a portion 21 connected to the cable 25, a uniform cylindrical rod 22 which extends away from the connected portion 21, and an enlarged abutment 23, i.e. having a diameter that is larger than that of the cylindrical rod 22. The lug 20 is made from a material that conducts electricity, for example metal.

The two portions 1, 2 of the locking sleeve 3 come together in order to catch the rod 22 of the lug 20, so as to enable relative translation and rotation between the terminal block 10 and the lug 20. The rod 22 therefore has a diameter that is slightly less than that of the locking sleeve 3, but a length which is greater than that of the locking sleeve 3. Consequently, the terminal block 10 enables the lug 20 to translate and rotate relative to the terminal block 10. More precisely, the movement carried out in this case between the terminal block 10 and the lug 20 is a translation of limited length (the length of the rod 22 less the length of the locking sleeve 3 in the zone where it surrounds the rod 22) and the rotation for an unlimited angle (and therefore 360°).

Moreover, it can be observed that, according to FIG. 2, the outside of the rod 22 and the inside of the sleeve 3 have similar shapes, i.e. cylindrical. Of course, it is not imperative that the locking sleeve 3 and the lug 20 be of cylindrical shape. Other complementary shapes can be carried out, for example, a sleeve defining an inner shape with a square section adapted for a lug with a rod with a square section. This then enables relative translation, but not relative rotation. Alternatively, even a sleeve with an octagonal section and cylindrical rod can also be suitable. The important thing is that the shapes of the sleeve and of the rod allow at least for the relative movement in translation, which will be apparent to those skilled in the art. However, the cylindrical shape is preferred in order to allow for the relative movement in translation and in rotation at the same time.

The substantially semi-cylindrical canal 7 oriented upwards from the first portion 1 (lower) is designed in two sections 7A and 7B. A first section 7A with a first diameter corresponding substantially to the diameter of the rod 22 (and the channel 8 of the second portion 2 of the sleeve 3), and a second section 7B with a larger diameter that corresponds substantially to the diameter of the enlarged abutment 23.

Moreover, the terminal block 10 also has a shoulder 7C, defined by the two sections 7A, 7B of the channel 7 at the level of the change in diameter. This shoulder 7C is used as an abutment for cooperating with the enlarged abutment 23 at the bottom of the rod 22, as such preventing the lug 20 from separating from the terminal block 10.

On the inner surface of the sleeve 3, two electrical contact plates 9 are "snap-fit", i.e. connected with a system of clips, in order to serve as interfaces between the sleeve 3 and the rod 22. The latter provide good electrical engagement between the terminal block 10 and the lug 20, while still enabling the relative movement between the two. The plates 9, of the multi-contact type, are made of metal, for example of copper, copper beryllium, nickel or silver, in order to enable good conduction. Furthermore, they have the characteristics of a spring blade in order to provide good uniform contact against the rod 22, and at the same time, a slight resistance against the movement thereof in order to reduce the play. These plates 9 can also be glued or crimped to the sleeve 3.

The terminal block 10, including the locking sleeve 3 thereof, is made of metal in order to facilitate the conduction of electricity between the busbar 12 and the cable 25. However, alternatively, the terminal block 10, including the sleeve 3, can be made of a material that does not conduct electricity, but being then supplied with a means of conducting electricity, for example a cable connecting the plates 9 to the busbar 12. In the same way, the lug 20 can be made of a non-conducting material, but supplied with a means of conducting electricity from the contact point with the terminal block 10 to the cable 25.

The locking sleeve 3 of this realisation is practical, and designed with few portions. As shown best in FIGS. 1A and 1B, the second portion 2 (upper) comprises an arm 13 extending from the side of the terminal block 10 and oriented downwards. The arm 13 supports a pin 14 that is engaged with the first portion 1 of the sleeve 3 on the side of the first portion 1 substantially opposite the side of the first portion 1 facing the second portion 2. In this case, the second portion 2 is located on the first portion 1 (on the top side of the first portion 1 which faces the second portion 2), but the pin thereof 14 is under the first portion 1 (on the side of the first portion 1 which is at the bottom, which is therefore substantially opposite the top side of the first portion 1). More particularly, the pin 14 of the first portion 1 of the sleeve 3 is engaged with a groove 11 provided under the first portion 1 of the sleeve. The two portions are inter-engage and as such pivot relative to one another, with the pin 14 forming a pivot element.

The axis of the pin 14 is substantially perpendicular to that (first axis) of the terminal block 10. This arrangement therefore allows the second portion 2 of the sleeve 3 to pivot in relation with the first portion 1 in order to as such open and close the sleeve 3. When the terminal block 10 is fastened onto an insulator or a panel, the pin 14 will be wedged between the terminal block 10 and the insulator (or panel) and cannot exit from this groove 11. For this purpose, an upturned portion can also be provided at the end of the pin 14. Therefore, even if the screw 16 for securing the sleeve 3 is not provided, the two portions 1, 2 of the sleeve 3 will remain together, due to the fact that the pin 14 is a single piece with the second portion 2 of the sleeve 3.

Another aspect of this invention further relates to foreign object damage (FOD). In addition to the fact that the electrical connection device 100, including the locking sleeve 3 thereof, is designed with few portions, the invention benefits from other anti-FOD characteristics, i.e. characteristics preventing, as much as possible, the device 100 from becoming damaged by a foreign body or causing foreign object damage.

Figure 3:
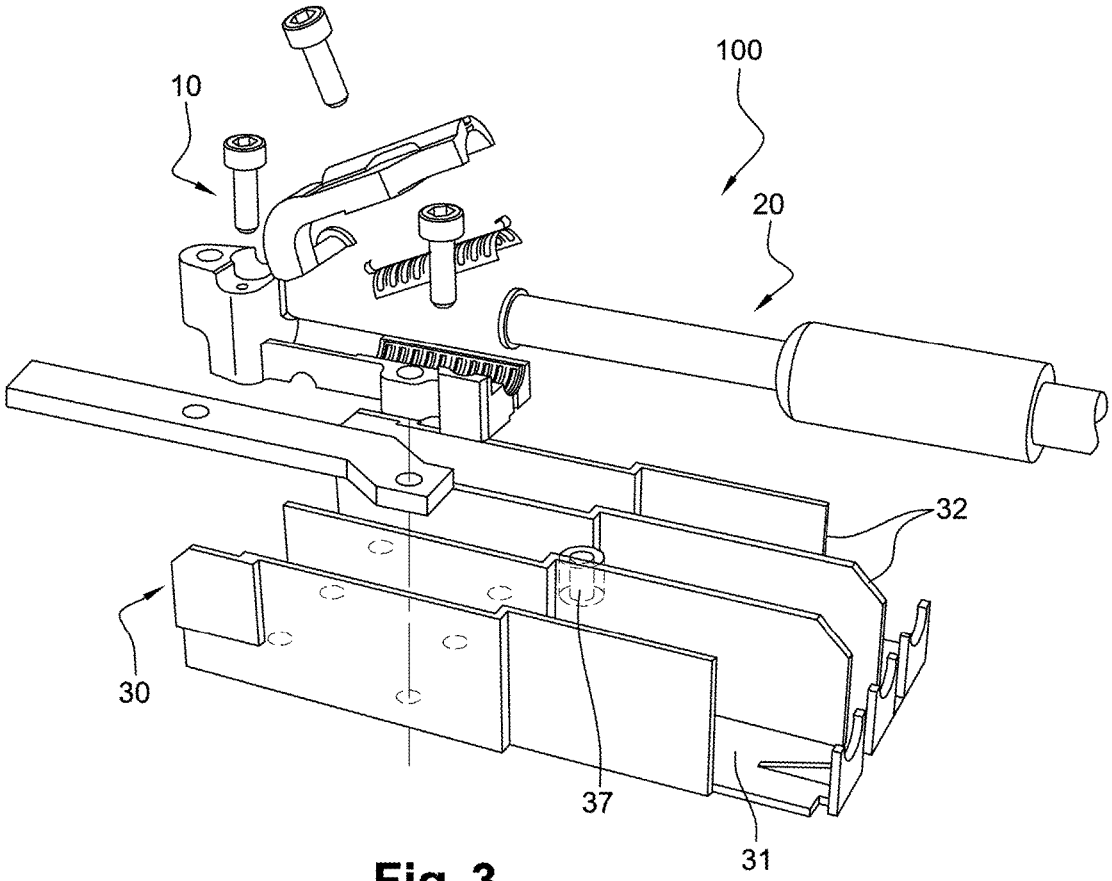
FIG. 3 shows a view of an insulator, with an exploded view of the electrical connection device according to the first embodiment, including a terminal block and a lug in such a way as to view the assembly in the insulator.

FIG. 3 as such shows a perspective view of an insulator 30 that has anti-FOD characteristics, and an exploded view of an electrical connection device 100 that makes it possible to view the way in which they are mounted in the insulator 30.

Figure 4:
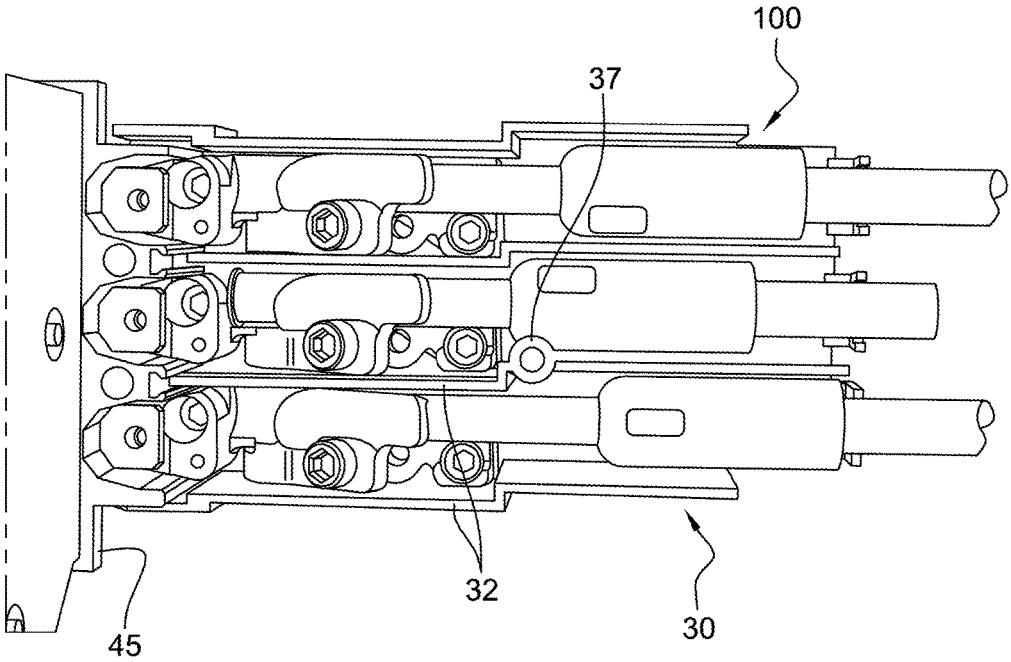
FIG. 4 shows a top view of several electrical connection devices according to the first embodiment arranged in an insulator, with a piece of electronic equipment in contact with the terminal blocks of the devices.

FIG. 4 shows several electrical connection devices 100 arranged in an insulator 30, and also with a contactor 45 arranged in contact with the terminal blocks 10.

These figures show the fact that the insulator 30 is provided with a bottom 31 and walls 32 on each side of the terminal block 10 and in the vicinity of each side of the latter. These walls 32 rise substantially vertically to a height higher than that of the busbars 12 and that of the terminal blocks 10. Furthermore, the walls extend substantially along the connection, i.e. substantially parallel and along the entire terminal block 10 and the entire lug 20. Each electrical connection device 100 is preferably insulated in its own insulator 30, or in its own compartment in the insulator 30. The insulator 30 is made from an insulating composite material, and resembles a casing.

In the case of an object, for example a tool of an installer, falling onto the insulator 30 wherein the electrical connection devices 100 are housed, it is highly likely that it will land on the walls 32 of the insulator 30 or on an electrical connection device 100 only. Consequently, the risk of an object touching two terminal blocks 10, two busbars 12 or two lugs 20 at the same time, as such causing a short circuit, is substantially reduced.

Figure 5:
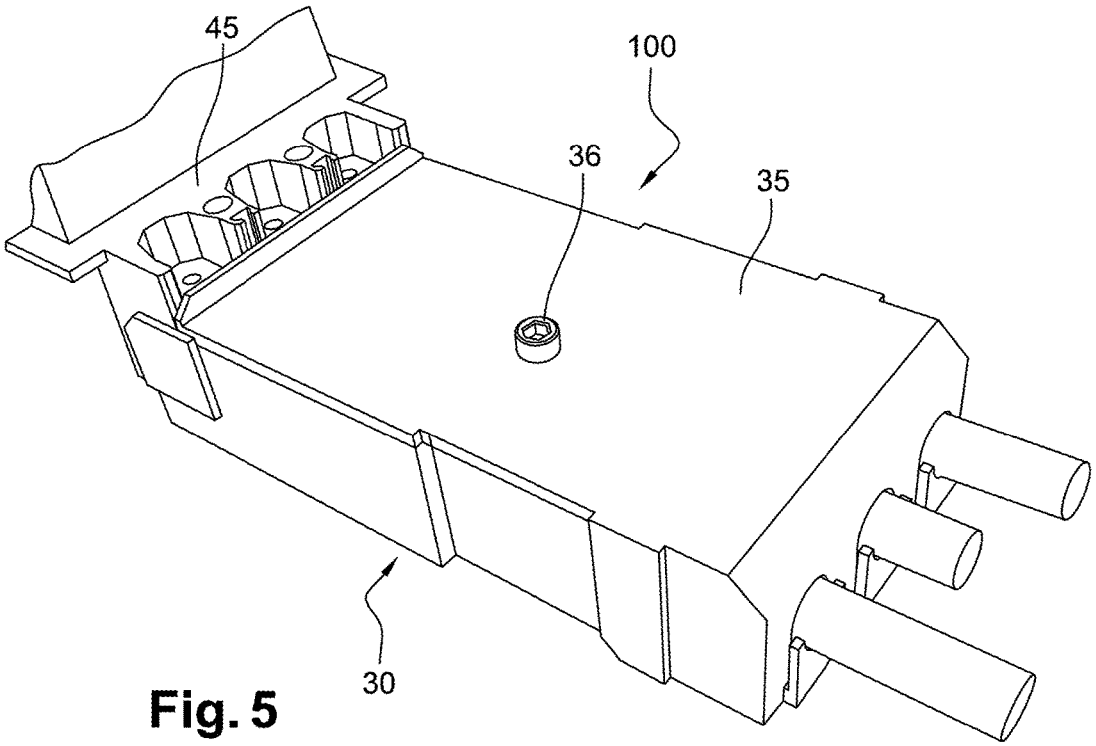
FIG. 5 shows a perspective view of several electrical connection devices according to the first embodiment arranged in an insulator as according to FIG. 4, with a cover of an insulator.

For additional anti-FOD protection, a cover can be incorporated in order to encase the electrical connection devices 100. FIG. 5 shows a cover 35 of an insulator 30 for enclosing the electrical connection devices 100. In this case, only the cables and the ends of the terminal blocks 10 are exposed on the electrical connection. The ends of the terminal blocks 10 are exposed in order to enable them to connect to the contactor 45, or other pieces of electrical equipment or other terminal blocks.

The cover 35 is also made from an insulating composite material. The cover 35 is snap-fit to the insulator 30 and is secured thereto with a fastening means, such as a captive screw 36 which engages a respective hole 37 located on the insulator 30. Cooperating flanges comprising recesses can be integrated into the insulator 30 and the cover thereof 35 in order to surround and support the cables 25 and potentially for providing resistance against the movement thereof. The insulator 30 electrically insulates the electrical connection devices 100 from the environment thereof and from one another and at the same time, reduced the probability of causing FOD, or being subjected to FOD.

Another anti-FOD characteristic relates to the fastening elements. The electrical connection device 100 comprises a few captive screws 16, 36 of a known type and which are frequently used, especially where the loss of screws is highly undesirable and can have serious consequences. This type of screw remains connected with one portion of the portions to be connected. In the other cases where the standard screws 15 are used, elastic pins 18 can be used to prevent the loss of these screws 15. Such a pin 18 can be seen clearly in FIG. 1A installed in its own hole passing through the hole 5 where there is a standard screw 15. In the case where such a screw 15 comes loose, the pin 18 would prevent it from completely exiting and separating from the device. More particularly, the screw head 15 abuts against the pin 18 during the translation thereof, and the screw 15 will as such be contained in the hole thereof 5.

Again, in order to reduce the number of parts, the electrical connection device 100 is designed in such a way that the elements for fastening secure several components at the same time. As shown in the figures, each terminal block 10 has two holes 5 on the first lower portion 1 in order to receive screws 15. The screws 15 pass through the terminal block 10, through the bulbar 12, through the insulator 30 and are secured on a structure, for example a honeycomb panel (not shown), in order to connect all parts together at the same time.

The embodiment described hereinabove is by way of example and must not be interpreted in a limiting way. It should be noted that other embodiments or improvements to the invention will be obvious for those skilled in the art without leaving the general scope of the invention.

For example, the terminal block and the lug are not necessarily made of metal or of a conducting material. However, it is preferable that they be made of metal, and of any such suitable metal, by way of examples, copper, nickel or silver.

Furthermore, other electrical contact plates can be incorporated for the purpose of improving the electrical conductivity. For example, such plates can be mounted at the interface between the two portions of the sleeve, and can be integrated with the electrical contact plates on the inside of the sleeve.

The sleeve can be designed to secure and to provide the necessary force to the lug via complete tightening of the sleeve (within the plates providing said necessary force) or by adjusting of the screw in order to lock the sleeve. In certain cases, once the lug is installed in the correct position, a high resistance against the movement thereof can be applied by strongly tightening the screw.

The sleeve can also be designed to open in the direction opposite the introduction of the lug. Even a block terminal with two locking sleeves can be considered, for example in order to receive two lugs of opposite directions in order to connect two cables together in a straight line. Although the terminal block has been primarily described as being in an assembly with a bulbar, it can also alternatively be combined with a piece of electrical equipment or a cable.

Of course, other types of fastening elements can be used instead of screws, and also other anti-FOD arrangements.

By the expression "relative movement between the terminal block and the lug", it must be understood that at least a portion of the terminal block moves relatively to at least a portion of the lug.

What is claimed is:

1. Device for an electrical connection (100) including a terminal block (10) adapted for being connected to a lug (20) of an electrical cable (25), the terminal block (10) comprising a locking sleeve (3) adapted for securing the lug (20) in such a way as to form an electrical connection enabling relative movement between the terminal block (10) and the secured lug (20), characterised in that the locking sleeve (3) comprises a first portion (1) and a second portion (2), as well as a pivot element (13, 14) configured such that the first and second portions (1, 2) pivot relative to one another in order to allow for the introduction of the lug (20) and the securing thereof, in that the pivot element of the locking sleeve (3) comprises a pin (14) connected to the second portion (2) of the locking sleeve (3) and engaged with the first portion (1) of the locking sleeve (3) on the side of the first portion (1) substantially opposite the side of the first portion (1) facing the second portion (2) of the locking sleeve (3), and in that said relative movement allowed is translation.

2. Device for an electrical connection according to claim 1, characterised in that the locking sleeve (3) of the terminal block (10) is configured to ensure a translation movement of the lug (20) over a limited length and for preventing the disconnection thereof of the locking sleeve (3) during translation.

3. Device for an electrical connection according to claim 1, characterised in that said relative movement allowed further comprises rotation.

4. Device for an electrical connection according to claim 1, characterised in that the pin (14) is located in a groove (11) formed in the first portion (1) of the locking sleeve (3), the pin (14) extending along an axis substantially perpendicular to an axis along which the terminal block extends substantially.

5. Device for an electrical connection as claim 1, characterised in that the locking sleeve (3) has a shape that is complementary with that of the lug (20) in order to allow for engagement therewith.

6. Device for an electrical connection according to claim 5, characterised in that the locking sleeve (3) defines a cylindrical space between the first and second portions (1, 2), the locking sleeve (3) being adapted for enabling engagement with a lug (20) with a cylindrical rod (22) and an enlarged termination (23), and in that the rod (22) has a diameter less than that of the locking sleeve (3) and a length greater than that of the locking sleeve (3).

7. Device for an electrical connection as claimed in claim 1, characterised in that the locking sleeve (3) comprises a fastening means (16) for the locking of the sleeve (3).

8. Device for an electrical connection as claimed in claim 1, characterised in that it further comprises a busbar (12) connected to the terminal block (12) in order as such to form a terminal block and busbar assembly, and an electrical cable (25) with a lug (20), the lug (20) having a cylindrical rod (22) and an enlarged termination (23), and in that the rod (22) has a diameter less than that of the locking sleeve (3) and a length greater than that of the locking sleeve (3).

9. Electrical connection device and insulator assembly, characterised in that it comprises an electrical connection device (100) as claimed in claim 1 and an insulator (30), the electrical connection device (100) being arranged in the insulator (30), the insulator (30) being provided with walls (32), the walls (32) extending substantially parallel to the axis of the terminal block (10) and rising to a height greater than that of the terminal block (10).

10. Assembly according to claim 9, characterised in that the insulator (30) comprises a cover (35) in order to encase the device (100).

* * * * *